United States Patent [19]

Rivera et al.

[11] 3,977,094

[45] Aug. 31, 1976

[54] POGO SHOES

[75] Inventors: Jose L. Rivera, Salt Lake City, Utah; George Spector, New York, N.Y.

[73] Assignee: Jose L. Rivera, Salt Lake City, Utah

[22] Filed: Oct. 12, 1973

[21] Appl. No.: 406,008

[52] U.S. Cl. ..... 36/7.8
[51] Int. Cl.[2] ..... A43B 3/10
[58] Field of Search ..... 36/2.5 R, 2.5 A, 7.8, 36/67 A, 67 D

[56] References Cited

UNITED STATES PATENTS 2,837,840 6/1958 Kerpel ..... 36/7.8

3,496,656 2/1970 Caine ..... 36/67 A

FOREIGN PATENTS OR APPLICATIONS 432,639 8/1926 Germany ..... 36/7.8

*Primary Examiner*—Patrick D. Lawson

[57] ABSTRACT

An attachment to a bottom of the shoes so to allow a wearer to spring up and down for purposes of fun, exercise or diversion; the attachment consisting of vertical tube attached at its upper end to the shoe sole, a compression coil spring inside the tube pushing downward against a bar inserted into the lower end of the tube so thus jumping up and down causes the spring to thrust a wearer high up in the air.

2 Claims, 4 Drawing Figures

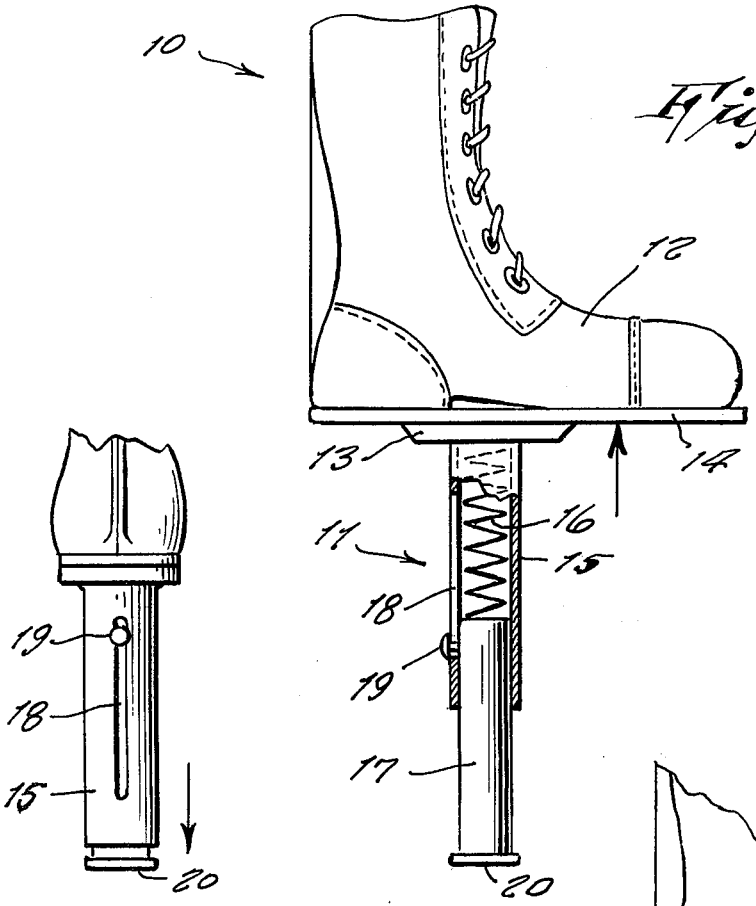
Fig. 1
Fig. 2
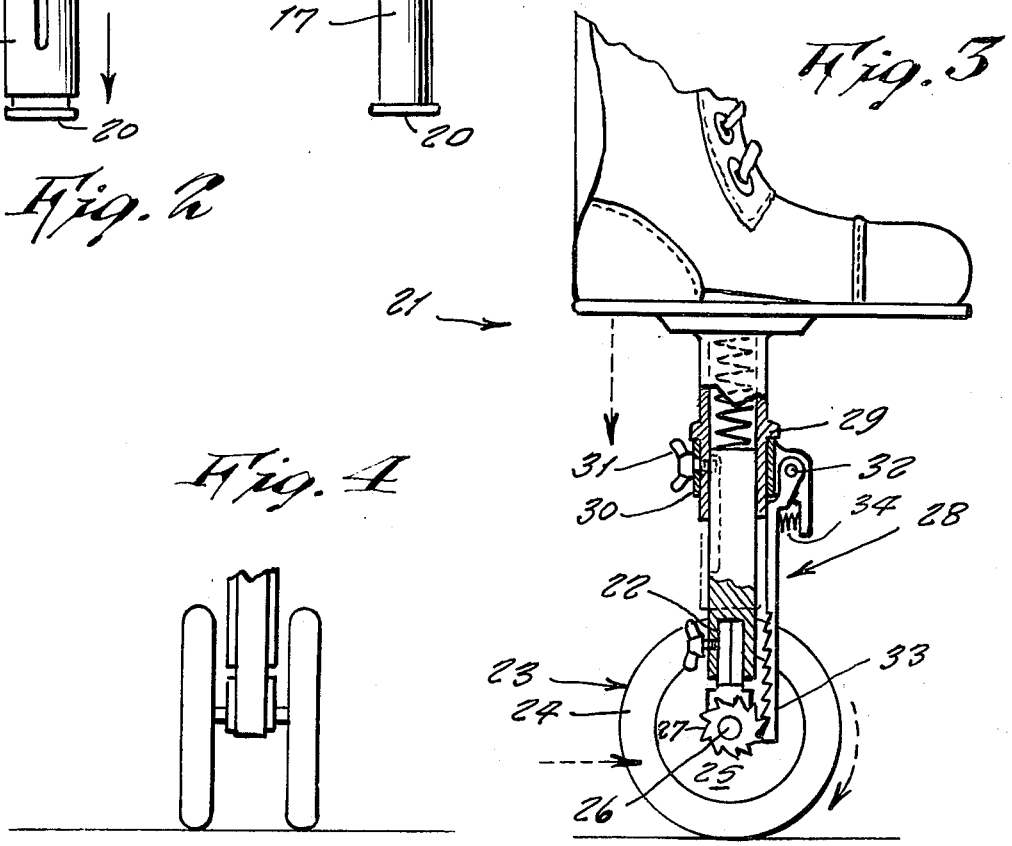
Fig. 3
Fig. 4

POGO SHOES

This invention relates generally to sporting goods and activity toys.

A principle object of the present invention is to provide pogo shoes in which a pogo stick principle is incorporated on a bottom of the shoes so that a wearer of the shoes can bounce up and down a great height.

Another object is to provide pogo shoes which provide fun and diversion as well as a healthy activity exercise.

Still another object is to provide pogo shoes which can be incorporated on shoes of adults as well as all ages of children.

Other objects are to provide a pogo shoes which is simple in design, inexpensive to manufacture, rugged in construction, easy to use and efficient in operation.

These and other objects will be readily apparent upon a study of the following specification and the accompanying drawing wherein:

FIG. 1 is a side cross sectional view of the invention shown in extended position.

FIG. 2 is a rear view thereof showing the device contracted.

FIG. 3 is a side cross sectional of a modified design of the invention which includes a removable wheel unit so the device can be used as shown in FIG. 1, but wherein when the wheel is attached, the reciprocal up and down motion causes the wheel to turn so a wearer can ride ahead.

FIG. 4 is a detail of a front view thereof.

Referring now to the drawing in detail, and more particularly to FIGS. 1 and 2 at this time, the reference numeral 10 represents a pogo show according to the present invention wherein there is an assembly 11 permanently mounted to the underside of a shoe 12, and includes a metal plate 13 secured to a show sole 14. A metal pipe or sleeve 15 secured to the plate extends downward therefrom, and contains a strong compression coil spring 16 within its upper portion. Within a lower portion of the sleeve there is slidably fitted a bar 17 that protrudes out of the lower end of the sleeve so that the bottom of the bar can be placed against a ground or floor. A longitudinal slot 18 in the sleeve receives a pin or rivet 19 secured to the bar and serves to prevent the spring to push the bar completely out of the sleeve, so that the parts do not become disengaged. A hard rubber pad 20 is fitted to the bottom of the bar 17 while the rest of all the structure is of metal.

For a practical size to most users, the sleeve may be 10 inches long, the bar 7 inches long and 3 inches in diameter.

In operative use, the wearer has a pogo show 10 on each foot and then urges his weight up and down on them so the spring increases his reciprocal up and down movement whereby he bounces clear off the ground.

In a modified design of the invention shown in FIGS. 3 and 4, the pogo show 21 includes all the above described structure, and additionally includes, instead of the rubber pad 20, slot 22 on its bottom end so to interchangable be fitted either with a pad 20 or a wheel unit 23 that includes pneumatic tire 24 on wheel 25 that is affixed on shaft 26 to which also is affixed a ratchet gear 27. A removable ratchet rack unit 28 can be fitted against a stop shoulder 29 of the sleeve, the unit including a collar 30 fitted with set screw 31, the collar pivotally supporting on pin 32 a ratchet rack 33 that is urged by compression spring 34 to engage the ratchet gear 27.

In operation, as a wearer bounces up and down, the wheel thus rotates in forwardly direction only so the wearer can thus travel ahead.

While various changes may be made in the detail construction, it is understood that such changes will be within the spirit and scope of the present invention as is defined by the appended claims.

What is claimed is:

1. A pogo shoe comprising a pogo stick assembly with a shoe mounted thereon, said assembly comprising a plate attached to the sole of the shoe including a sleeve with a spring mounted therein, including a bar slidably mounted in said sleeve bearing against said spring, said bar projecting from one end of the sleeve having a ground bearing member mounted at the lower end of the bar, said sleeve having a longitudinal slot coacting with a transverse pin projecting from said bar whereby the bar is guided for non-rotational longitudinal reciprocation in said sleeve, and said member is a wheel and axle rotatably mounted on the lower end of the bar including means for causing wheel rotation as the bar reciprocates longitudinally.

2. The combination of claim 1 wherein said means comprises a pinion gear mounted on the axle and a rack mounted on the sleeve adjacent to and coacting with said rack to rotate the wheel and axle as the bar reciprocates.

* * * * *